US006214438B1

(12) United States Patent
Prick

(10) Patent No.: US 6,214,438 B1
(45) Date of Patent: Apr. 10, 2001

(54) INSULATION MATERIAL, METHOD FOR PRODUCING SAID INSULATION MATERIAL AND DEVICE FOR CARRYING OUT SAID METHOD

(76) Inventor: Raoul Guilielmus Boudewijn Marie Prick, Bemelerweg 20, NL-6226 HA, Maastricht (NL)

( * ) Notice: Subject to any disclaimer, the term of this patent is extended or adjusted under 35 U.S.C. 154(b) by 0 days.

(21) Appl. No.: 09/147,811

(22) PCT Filed: Sep. 11, 1997

(86) PCT No.: PCT/NL97/00516

§ 371 Date: Jun. 25, 1999

§ 102(e) Date: Jun. 25, 1999

(87) PCT Pub. No.: WO98/11308

PCT Pub. Date: Mar. 19, 1998

(30) Foreign Application Priority Data

Sep. 12, 1996 (NL) ..... 1004014
Jan. 31, 1997 (NL) ..... 1005149

(51) Int. Cl.[7] ..... E04B 1/74; B32B 3/12

(52) U.S. Cl. ..... 428/117; 428/317.1; 428/317.9; 428/71

(58) Field of Search ..... 428/117, 317.1, 428/313.5, 317.5, 317.9, 71

(56) References Cited

U.S. PATENT DOCUMENTS 4,271,876 * 6/1981 Nash et al. ..... 141/12
5,455,096 * 10/1995 Toni et al. ..... 428/117 X
5,776,579 * 7/1998 Jessup et al. ..... 428/117 X

FOREIGN PATENT DOCUMENTS

WO 93/25492 * 12/1993 (WO) .

* cited by examiner

*Primary Examiner*—Daniel Zirker
(74) *Attorney, Agent, or Firm*—Oblon, Spivak, McClelland, Maier & Neustadt, P.C.

(57) ABSTRACT

An insulation material and method for producing it. A basic material is built up of cells and a filler which is present in the cells. The filler is built up of separate fibers which are bonded together by means of a foam-like bonding agent. The filler is introduced into the open cells of the basic material. A mixture of separate fibers and a foam-like bonding agent is prepared and the mixture is introduced into the open cells by way of a nozzle.

20 Claims, 2 Drawing Sheets

INSULATION MATERIAL, METHOD FOR PRODUCING SAID INSULATION MATERIAL AND DEVICE FOR CARRYING OUT SAID METHOD

BACKGROUND OF THE INVENTION

1. Field of the Invention

The invention relates to an insulation material comprising a basic material which is built up of cells and a filler which is present in said cells.

The invention furthermore relates to a method for producing such insulation material and to a device for carrying out the method in order to obtain the intended insulation material.

2. Discussion of the Background

From U.S. Pat. No. 4,271,876 it is known to use insulation material comprising a basic material built up of cells for producing prefabricated building components. The thermal and acoustic insulation value of such building components incorporating basic materials built up of cells can be further enhanced, however. The improvement of the thermal and acoustic insulation of such insulation material may take place by filling the cells with a filler of for example mineral wool fibres or cellulose fibres.

The term fibres used herein is understood to mean short, elongated particles, but also granular particles and the like.

Several experiments have been conducted within this framework, but it has become apparent that it is very difficult to fill the cells properly with such relatively light fibres. As a result of the problems involved in the filling of such basic material the use of this insulation material has not led to the expected large-scale use, because the increasingly stringent requirements with regard to the insulation value are not met.

SUMMARY OF THE INVENTION

The object of the invention is to provide an insulation material whereby fibres have been introduced into the cells of the basic material in a simple manner.

This objective is accomplished with the basic material according to the invention in that said filler is built up of separate fibres, which are bonded together by means of a foam-like bonding agent.

The foam will make the fibres heavier, as a result of which the fibres can be introduced into the cells of the basic material by the force of gravity. Fibres not bonded to bonding agent are relatively too light, and they exhibit a tendency to remain on top of the basic material.

A major advantage of the insulation material according to the invention is the fact that it has a high insulation value and that the filler can be introduced into the cells in a simple manner.

It has to be noted that from WO 93/25492 an isulation material is known comprising fibres which are bonded together by means of a foamlike bonding agent. However, this insulation material is used as such.

Another object of the invention is to provide a method wherein fibres can be introduced into the cells of the basic material in a simple manner.

This objective is accomplished with the method according to the invention in that first a mixture of separate fibres and a foam-like bonding agent is prepared, and that this mixture is introduced into the open cells of the basic material via a nozzle.

The fibres, which are weighted and bonded by the foam, can be introduced into the cells of the basic material in a simple manner, for example under the influence of the force of gravity.

One embodiment of the method according to the invention is characterized in that said filler is defibered into fibres, the fibres are subsequently bonded together by means of the bonding agent, after which the bonded fibres are defibered anew and introduced into the cells of the basic material.

By defibering the filler relatively small fibres or separate particles will be obtained. Said fibres are subsequently bonded to the bonding agent, as a result of which the specific weight of each fibre will increase. The fibres will also adhere together as a result of the presence of the bonding agent. When subsequently the fibres provided with the bonding agent are defibered, fibres weighted by the bonding agent will be obtained, which will fall into the cells of the basic material under the influence of the force of gravity. It is also possible, of course, to blow or suck the fibres into the cells of the basic material.

One embodiment of the method according to the invention is characterized in that upon providing the fibres with the bonding agent, the fibres are formed into a foam by means of the bonding agent, which foam is subsequently defibered.

Defibering the foam will result in the formation of separate fibres surrounded by bonding agent, which can be introduced into the cells of the basic material in a simple manner. The fibres will adhere together again once they are in the cell, to which adhering process the bonding agent will be conducive.

Another embodiment of the method according to the invention is characterized in that the basic material is vibrated while the fibres are being introduced into the cells.

The vibration of the basic material will cause the particles being introduced into the cells to move downward, thus creating space for additional fibres near the upper side of the cells. In this manner the cells will be entirely filled with fibres.

The invention also relates to a device suitable for carrying out the method, which comprises a filling station, which device is characterized in that said filling station is provided with a mixer for mixing said bonding agent and said fibres, so as to obtain said filler.

The fibres are bonded to the bonding agent by means of such a device before being introduced into the cells of the basic material.

One embodiment of the device according to the invention is characterized in that the device comprises a first defibering apparatus, a mixer connected to said first defibering apparatus via a pipe, which mixer is connected, via a further pipe, to a second defibering apparatus, which is provided with an outlet opening.

With such a device the first defibering apparatus is used for reducing the insulation material to fibres. The second defibering apparatus is used for separating the fibres, which adhere together as a result of the presence of the bonding agent.

BRIEF DESCRIPTION OF THE DRAWINGS

The invention will be explained in more detail with reference to the drawing, in which.

DETAILED DESCRIPTION OF THE PREFERRED EMBODIMENTS

Figure 1:
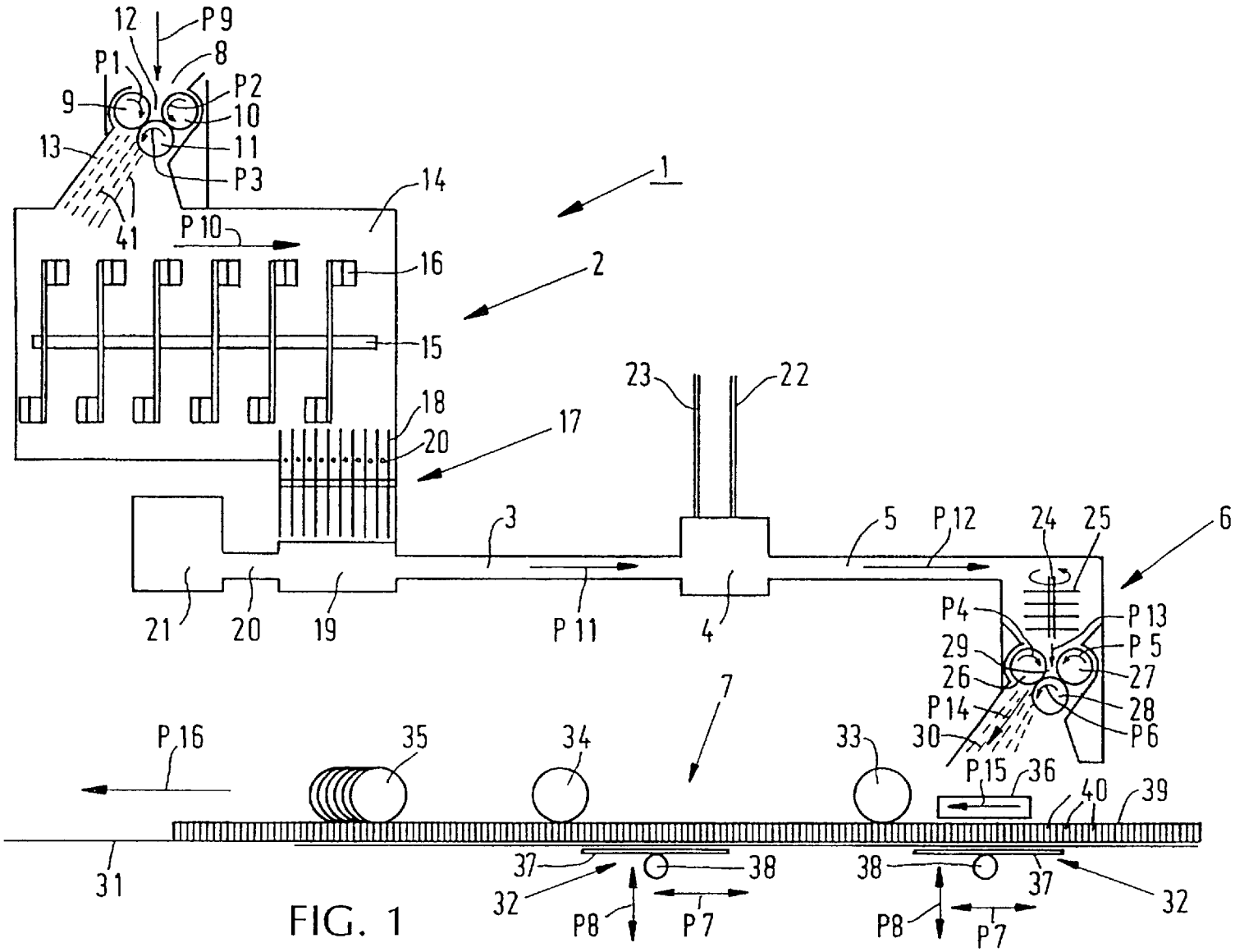
FIG. 1 is a longitudinal sectional view of a device according to the invention.

FIG. 1 shows a device 1 comprising a first defibering apparatus 2, a mixer 4, which is connected to defibering apparatus 2 via a flexible pipe 3, a second defibering apparatus 6, which is connected to mixer 4 via a flexible pipe 5, and a conveyor 7, which is disposed under defibering apparatus 6.

Defibering apparatus 2 is provided with an inlet channel 8, under which three rotatable rollers 9, 10, 11 fitted with wire brushes are disposed. Roller 9 abuts against roller 11. A feeding gap 12 is present between rollers 9, 10. Roller 9 is driven in clockwise direction, as indicated by arrow P1, whilst rollers 10, 11 are driven in anti-clockwise direction, as indicated by arrows P2, P3. The speeds at which rollers 9, 11 are driven in the direction indicated by arrow P1, P3 and the pressure with which roller 9 is driven against roller 11 can be adjusted and varied.

Defibering apparatus 2 is provided with a passage 13 under rollers 9, 10, 11, which passage opens into a space 14. Present in space 14 is a blade wheel 16, which bears on a shaft 15 and by means of which fibres coming from passage 13 are transported. Disposed under space 14 is a dividing apparatus 17, which is provided with a number of rods 18 coupled to a central shaft, which rods extend between fixedly disposed rods 20. Disposed under apparatus 17 is a dividing station 19. An air blowing unit 21, which is driven by means of a motor, is connected to dividing station 19 via a pipe 20. Dividing station 19 is connected to mixer 4 via flexible pipe 3. Mixer 4 is furthermore provided with a supply pipe 22 for compressed air and with a supply pipe 23 for a bonding agent. Mixer 4 is connected to a second defibering apparatus 6 via a pipe 5. Defibering apparatus 6 comprises a blade wheel 25 near an upper side, which is rotatable about a shaft 24, and rollers 26, 27, 28, which are disposed under blade wheel 25. Rollers 26, 28, which are provided with wire brushes, abut against one another. A gap 29 is present between roller 26 and roller 27. Rollers 26, 28, 28 are rotatable in directions indicated by arrows P4, P5 and P6 respectively. An outlet opening 30, which opens above conveyor 7, is present under rollers 26, 27, 28. Conveyor 7 is provided with a conveyor belt 31, a number of vibrating devices 32 disposed under conveyor belt 31, and a number of brushes 33, 34, 35, which are disposed an adjustable distance above conveyor belt 31. Conveyor 7 is furthermore provided with a strickling brush 36. Vibrating devices 32 are each provided with a vibrating plate 37, which is reciprocated in the directions indicated by double arrows P7, P8 by means of a drive unit 38. Plate-shaped material 39 comprising a plurality of cells 40 is present on conveyor belt 31. Cells 40 form a honeycomb structure in plate 39. Brushes 33, 34 are rotatable about an axis extending transversely to the plane of the drawing. Brush 35 is rotatable about an axis including an acute angle with the plane of the drawing.

The operation of device 1 will now be briefly explained. Relatively large pieces of filler, for example in the shape of plates or pieces, are supplied to defibering apparatus 2 in the direction indicated by arrow P9 via inlet opening 8. Said filler is pulled into gap 12 by rollers 9, 10, from where the filler is pulled between rollers 9, 11 and transported in the direction of passage 13. Rollers 9, 11 are driven at different speeds, as a result of which the filler is pulled apart into fibres. Fibres 41 whirl into space 14 and are transported in the direction indicated by arrow P10 by means of rotating blade wheel 16. Then the fibres are grabbed by the rods 18 of device 17, which rotate about the shaft, and carried into device 19. The filler being introduced into inlet 8 is pulled completely apart by rollers 9, 11, blade wheel 16 and rotating rods 18, and divided into relatively small fibres. Air blowing device 21 blows air into device 19 via pipe 20, as a result of which the fibres present in the device 19 are carried into pipe 3. The fibres are blown further apart by the air flow. The fibres are transported through pipe 3 in the direction indicated by arrow P11, to mixer 4. Compressed air and a bonding agent are supplied to mixer 4 via pipe 22 and pipe 23 respectively, as a result of which the fibres present in mixer 4 are efficiently bonded to the bonding agent. The fibres, which are bonded to the bonding agent and which are provided with bonding agent are blown in the direction indicated by arrow P12 into pipe 5 by the air flow produced by device 21, from where the fibres provided with bonding agent, which adhere together by now, are carried into defibering apparatus 6. The bonded-together fibres are pulled slightly apart by the blade wheel 25 rotating about shaft 24. Then the fibres are passed in the gap 29 between rollers 26, 27 in the direction indicated by arrow P13. Rollers 26, 28 are driven at different, variable speeds, as a result of which the bonded-together fibres are pulled apart and carried in the direction indicated by arrow P14 towards outlet 30. Outlet 30 is located above the plate 39 comprising cells 40, and the fibres provided with bonding agent, which have been separated from each other by defibering apparatus 6, will fall into cells 40 under the influence of the force of gravity. Base plate 39 is vibrated to and fro by means of vibrating devices 32 disposed under conveyor belt 31, as a result of which the fibres falling into cells 40 will move further in downward direction. The fibres falling onto plate 38 are swept into cells 40 by means of brush 36, which is driven in the directions indicated by double arrow P15 and in directions extending transversely thereto.

During the filling of cells 40 base plate 39 is slowly moved in the direction indicated by arrow P16 by means of conveyor belt 31. During said movement the fibres still present on plate 39 are swept into cells 40 by brushes 33, 34. Any fibres remaining on the plate are swept off said plate by brush 35, which is disposed at an angle with respect to brushes 33, 34.

Figure 2:
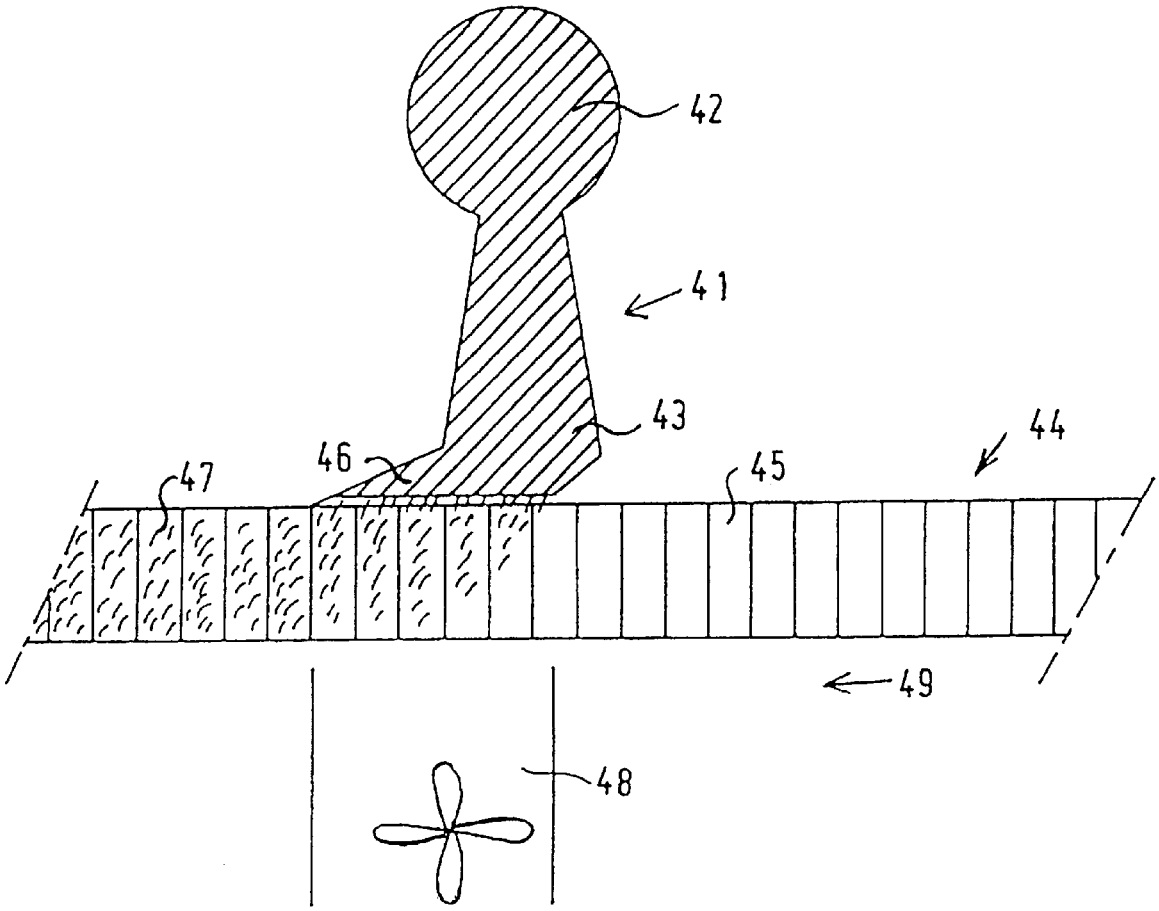
FIG. 2 shows another device according to the invention.

FIG. 2 diagrammatically shows another device for producing the insulation material according to the invention.

FIG. 2 shows filling station 41 comprising a mixing head 42, in which the filler is mixed by supplying the mineral wool fibres or the cellulose fibres as well as the bonding agent. Following the mixing step the foam thus formed is introduced into cells 45 of honeycomb 44 via outlet 43. Filling station 41 is furthermore provided with a strickle 46, so that excess foam-like filler is removed and transferred to incompletely filled cells. The filled cells 47 contain a filler, which is dried, if necessary, so that the fibres are surrounded by cured foam, resulting in a cohesion between the individual fibres mutually and an adherence to the cell surfaces. Thus the cells are filled with an insulating filler.

In order to promote the evacuation of the air from the honeycomb structure 44, an air exhaust channel 48 is provided at the bottom side, by means of which air is exhausted, without any filler being carried along. The honeycomb is passed under the filling station in the direction indicated by arrow 49, whereby the combs are gradually filled with foam consisting of said material mixed with the separate particles, so that a honeycomb structure filled with a filler is formed, as a result of which the insulation value is enhanced in comparison with the honeycomb structure which is not filled with a filler.

Any material with which the individual fibres can easily be weighted may be used as the bonding agent. The fibres may first be moisturized and weighted by means of the bonding agent and subsequently be bonded together and dried in the cells.

What is claimed is:

1. An insulation material comprising:

a basic material formed of cells, each cell being entirely filled with a filler composed of separate fibers bonded together by a foam bonding agent.

2. An insulation material according to claim 1, wherein:

said foam bonding agent envelops each of the separate fibers to provide a mutual bond between the fibers.

3. An insulation material according to claim 1, wherein:

each of the cells has a venting slot on a side opposite to a side through which each cell is filled.

4. An insulation material according to claim 1, wherein:

said filler includes one of mineral wool fibers, cellulose fibers and granulates.

5. An insulation material according to claim 1, wherein:

said insulation material is an insulation plate.

6. A method for producing an insulation material, comprising the steps of:

making a mixture of separate fibers and a foam bonding agent into a filler; and introducing the filler into open cells in a basic material via a nozzle.

7. A method according to claim 6, further comprising the step of:

defibering the filler after the mixture making step but before the introducing step.

8. A method according to claim 6, further comprising the step of:

defibering the separate fibers preliminarily before the mixture making step.

9. A method according to claim 6, further comprising the step of:

vibrating the basic material simultaneously during the introducing step.

10. A method according to claim 7, further comprising the step of:

transporting the mixture through an elongated pipe after the mixture making step but before the defibering step.

11. A method according to claim 6, further comprising the step of:

selecting preliminarily one of mineral wool fibers, cellulose fibers and granulates as the separate fibers for the mixture making step.

12. A method according to claim 6, further comprising the step of:

passing the basic material under a filling station simultaneously during the introducing step.

13. A method according to claim 6, further comprising the step of:

strickling excess filler off tops of the open cells in the basic material subsequent to the introducing step.

14. A method according to claim 6, further comprising the step of:

generating a subatmospheric pressure on a side opposite to a filling hole in each of the open cells simultaneously during the introducing step.

15. A method according to claim 6, further comprising the step of:

exhausting air from each of the open cells simultaneously during the introducing step.

16. A device for producing an insulation material, said device comprising:

a mixer configured to mix separate fibers and a foam bonding agent into a filler; and a station configured to introduce the filler into open cells in a basic material passing thereunder.

17. A device according to claim 16, further comprising:

a first defibering apparatus arranged upstream of the mixer; and a second defibering apparatus interposed between the mixer and the station.

18. A device according to claim 16, further comprising:

a vibrator disposed under the station and configured to shake the open cells in the basic material while the filler is introduced therein.

19. A device according to claim 16, further comprising:

at least one strickle configured to remove excess filler from tops of the open cells in the basic material after the filler is introduced therein.

20. A device according to claim 17, further comprising:

a stirrer arranged in the second defibering apparatus.

* * * * *